US007965964B2

(12) United States Patent
Ochiai et al.

(10) Patent No.: US 7,965,964 B2
(45) Date of Patent: Jun. 21, 2011

(54) DEVELOPING ROLLER, DEVELOPING APPARATUS, AND IMAGE FORMING APPARATUS

(75) Inventors: Norikazu Ochiai, Izu (JP); Mitsuhisa Kato, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 278 days.

(21) Appl. No.: 12/062,014

(22) Filed: Apr. 3, 2008

(65) Prior Publication Data

US 2009/0052951 A1 Feb. 26, 2009

Related U.S. Application Data

(60) Provisional application No. 60/957,320, filed on Aug. 22, 2007.

(51) Int. Cl.
*G03G 15/09* (2006.01)

(52) U.S. Cl. ..... 399/276; 399/265; 399/267

(58) Field of Classification Search ..... 399/222, 399/252, 265, 267, 276
See application file for complete search history.

(56) References Cited

U.S. PATENT DOCUMENTS

| | | | | |
|---|---|---|---|---|
| 4,819,027 | A * | 4/1989 | Murasaki et al. | 399/270 |
| 5,311,263 | A * | 5/1994 | Suzuki et al. | 399/276 |
| 5,749,033 | A * | 5/1998 | Swartz et al. | 399/267 |
| 6,925,277 | B2 | 8/2005 | Sugihara | |
| 2004/0028428 | A1 * | 2/2004 | Sugihara | 399/267 |
| 2008/0008503 | A1 * | 1/2008 | Imamura et al. | 399/276 |
| 2009/0148195 | A1 * | 6/2009 | Ochiai | 399/276 |

FOREIGN PATENT DOCUMENTS

| | | | |
|---|---|---|---|
| JP | 60142369 | A * | 7/1985 |
| JP | 08160736 | A * | 6/1996 |

* cited by examiner

*Primary Examiner* — David P Porta
*Assistant Examiner* — Casey Bryant
(74) *Attorney, Agent, or Firm* — Turocy & Watson, LLP

(57) ABSTRACT

A developing roller according to the invention includes a columnar magnet roller, and a cylindrical sleeve that houses the magnet roller. A plurality of fragmented micro recesses is formed on the surface of the sleeve. The micro recesses are arranged dispersively both in an axial direction and in a circumferential direction of the sleeve.

15 Claims, 13 Drawing Sheets

| | CONVENTIONAL EXAMPLE | | | THIS EMBODIMENT | | | |
|---|---|---|---|---|---|---|---|
| SHAPE OF SLEEVE PATTERN | KNURLING | | | DISPERSED MICRO RECESSES | | | |
| | 60 GROOVES PARALLEL TO AXIS IN CIRCUMFERENTIAL | | | SIZE OF MICRO RECESS (SIZE OF CELL) | | | |
| | WIDTH OF GROOVE: ABOUT 0.2mm | | | 0.2mm*0.2mm | 0.3mm*0.3mm | 0.4mm*0.4mm | 0.5mm*0.5mm |
| SURFACE PROCESSING METHOD | ETCHING | | | ETCHING | | | |
| DEPTH OF RECESS | 30 μm | 50 μm | 70 μm | 50~90 μm | | | |
| CONDITION OF IMAGE | DEFECTIVE (WITH TRACES) | DEFECTIVE (WITH TRACES) | DEFECTIVE (WITH TRACES) | GOOD (NO UNWANTED TRACES) | GOOD (NO UNWANTED TRACES) | GOOD (NO UNWANTED TRACES) | GOOD (NO UNWANTED TRACES) |

FIG.8

CHANGE IN DEPTH OF GROOVE ON SLEEVE WITH RESPECT TO THE NUMBER OF SHEETS PRINTED(THIS EMBODIMENT)

CHANGE IN QUANTITY OF DEVELOPER CARRIED WITH RESPECT TO THE NUMBER OF SHEETS PRINTED(THIS EMBODIMENT)

CHANGE IN SURFACE ROUGHNESS WITH RESPECT TO TIME OF USE(CONVENTIONAL EXAMPLE:SANDBLASTING)

CHANGE IN QUANTITY OF DEVELOPER CARRIED WITH RESPECT TO TIME OF USE(CONVENTIONAL EXAMPLE:SANDBLASTING)

DEVELOPING ROLLER, DEVELOPING APPARATUS, AND IMAGE FORMING APPARATUS

BACKGROUND OF THE INVENTION

1. Technical Field of the Invention

The present invention relates to a developing roller, a developing apparatus, and an image forming apparatus, and particularly to a developing roller, a developing apparatus, and an image forming apparatus for carrying toner to a photoconductive unit and developing a toner image on the photoconductive unit.

2. Related Art

Conventionally, an image forming apparatus such as a copy machine, printer or multi-functional peripheral (MFP) employs an electrophotographic system in which an electrostatic latent image on a photoconductive drum is developed by a developing apparatus having a developing roller.

Of the surface area of the developing roller, an area facing the photoconductive drum is called a developing area. The developing apparatus causes a stirred developer (in the case of a two-component developer, it contains toner and magnetic particles) to adhere to the surface of the developing roller, and carries it to the developing area. The toner is electrically charged by being stirred and is attracted from the developing roller to the photoconductive drum because of the potential difference between the developing roller and the photoconductive drum in the developing area. Thus, the electrostatic latent image on the photoconductive drum is developed as a toner image.

To cause the developer to adhere to the surface of the developing roller and carry the developer to the developing area, the surface of the developing roller must have friction resistance. Therefore, surface treatment to form small recesses and protrusions is performed on the surface of the developing roller, instead of forming a perfectly smooth surface.

As conventionally known surface treatment for the developing roller, sandblasting and knurling may be employed.

A surface processed by sandblasting is a granulated rough surface and has high friction resistance. However, as it is used for a long period, the surface is ground by the developer and its surface roughness is gradually lowered. Consequently, friction resistance is lowered and the developer cannot be carried stably.

On the other hand, knurling is processing to form multiple grooves parallel to the axis of the developing roller, on the surface of the developing roller, as disclosed in U.S. Pat. No. 6,925,277 and so on. Each groove has a length that is approximately the same as the length of the developing roller in the axial direction. The multiple grooves formed on the surface generate high friction resistance to the developer. Moreover, since deeper recesses can be formed than in sandblasting, friction resistance is not significantly lowered even if the developing roller is used for a long period.

However, when development is carried out with the developing roller processed by knurling, there is a problem that an unwanted stripe pattern corresponding to the grooves are generated on the developed toner image. This unwanted stripe pattern is particularly conspicuous in a broad, solid area such as a blue sky background.

With the developing roller processed by sandblasting, such an unwanted stripe pattern is not generated, but there is a problem of performance deterioration due to change with time.

SUMMARY OF THE INVENTION

In view of the above circumstances, it is an object of the invention to provide a developing roller, a developing apparatus, and an image forming apparatus in which no unwanted stripe pattern is generated and there is no performance deterioration due to change with time.

To achieve the above object, a developing roller according to an aspect of the invention includes a columnar magnet roller, and a cylindrical sleeve that houses the magnet roller. A plurality of fragmented micro recesses is formed on the surface of the sleeve. The micro recesses are arranged dispersively both in an axial direction and in a circumferential direction of the sleeve.

A developing apparatus according to another aspect of the invention includes a stirring unit configured to stir a developer, a developing roller that has the stirred developer adhering to its surface and carries the developer to a position facing a photoconductor, and a doctor blade that regulates the thickness of the developer adhering to the developing roller. The developing roller has a columnar magnet roller, and a cylindrical sleeve that houses the magnet roller. A plurality of fragmented micro recesses is formed on the surface of the sleeve. The micro recesses are arranged dispersively both in an axial direction and in a circumferential direction of the sleeve.

An image forming apparatus according to still another aspect of the invention includes a photoconductive drum, an exposing device that casts light to the photoconductive drum and forms an electrostatic latent image on the surface of the photoconductive drum, a developing apparatus that causes toner to adhere to the electrostatic latent image and develops a toner image, a transfer device that transfers the developed toner image onto a sheet, and a fixing device that fixes the toner image transferred onto the sheet. The developing apparatus has a stirring unit configured to stir a developer, a developing roller that has the stirred developer adhering to its surface and carries the developer to a position facing a photoconductor, and a doctor blade that regulates the thickness of the developer adhering to the developing roller. The developing roller has a columnar magnet roller, and a cylindrical sleeve that houses the magnet roller. A plurality of fragmented micro recesses is formed on the surface of the sleeve. The micro recesses are arranged dispersively both in an axial direction and in a circumferential direction of the sleeve.

BRIEF DESCRIPTION OF THE DRAWINGS

In the attached drawings,

FIG. 8 is a table showing the result of visual recognition and determination of the condition of an image printed with the developing roller processed by knurling according to the conventional example, and the condition of an image printed with the developing roller according to the first embodiment;

DETAILED DESCRIPTION OF THE EMBODIMENTS

Embodiments of a developing roller, a developing apparatus, and an image forming apparatus according to the invention will be described with reference to the attached drawings.

(1) Image Forming Apparatus

Figure 1:
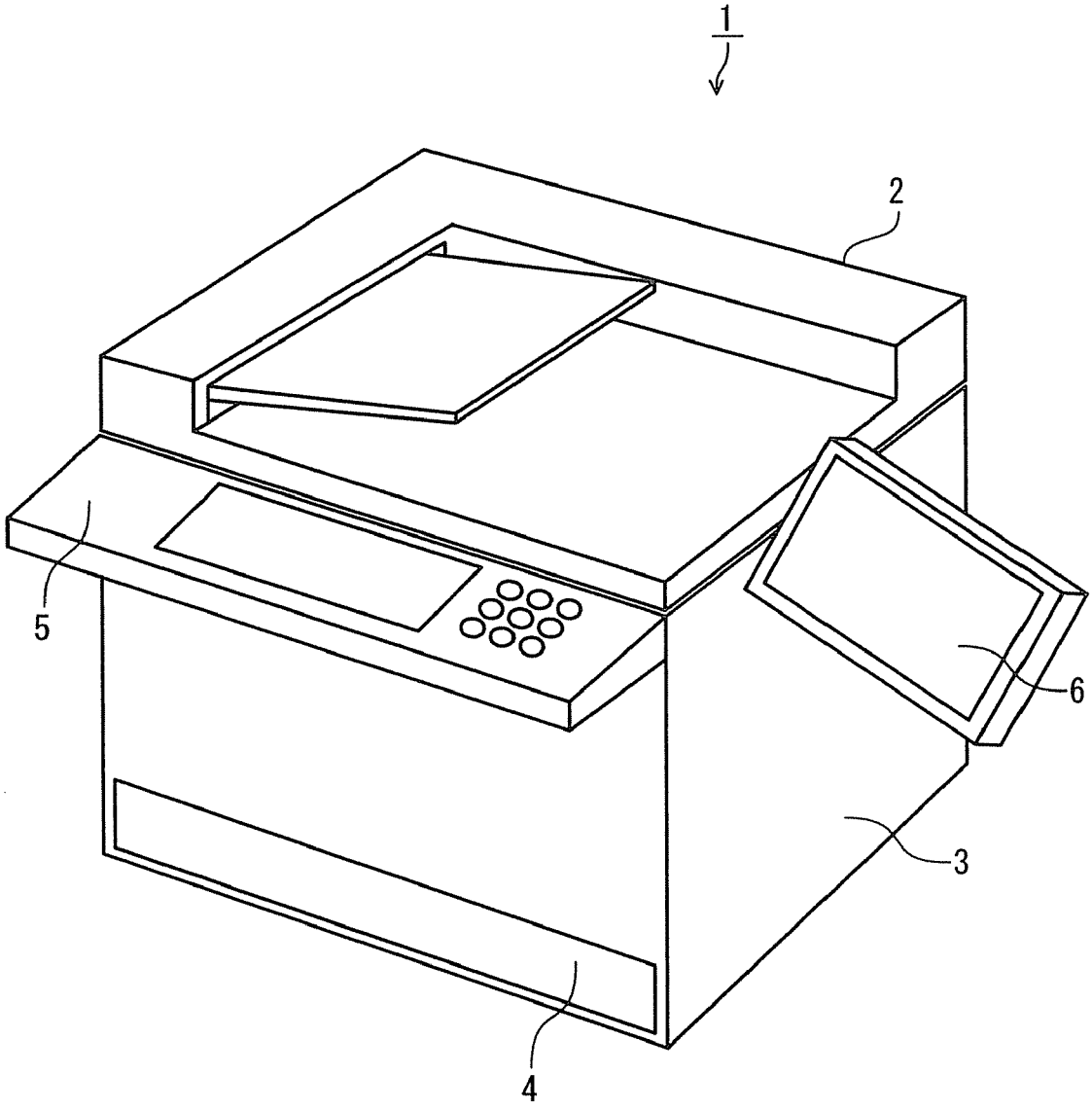
FIG. 1 is a perspective view showing an exemplary appearance of an image forming apparatus according to an embodiment of the invention.

FIG. 1 is a view showing an exemplary appearance of a copy machine (or MFP) as a typical example of an image forming apparatus 1 according to this embodiment.

The image forming apparatus 1 has a scanning unit 2, an image forming unit 3, a paper feed unit 4 and so on.

The scanning unit 2 optically scans an original set on an original table or an original inputted by an automatic document feeder (ADF) and generates image data.

The image forming unit 3 prints the image data onto a sheet supplied from the paper feed unit 4, by an electrophotographic system. The image forming unit 3 also has a control panel 5 on which a user carries out various operations, and a display panel 6 that displays various information.

Figure 2:
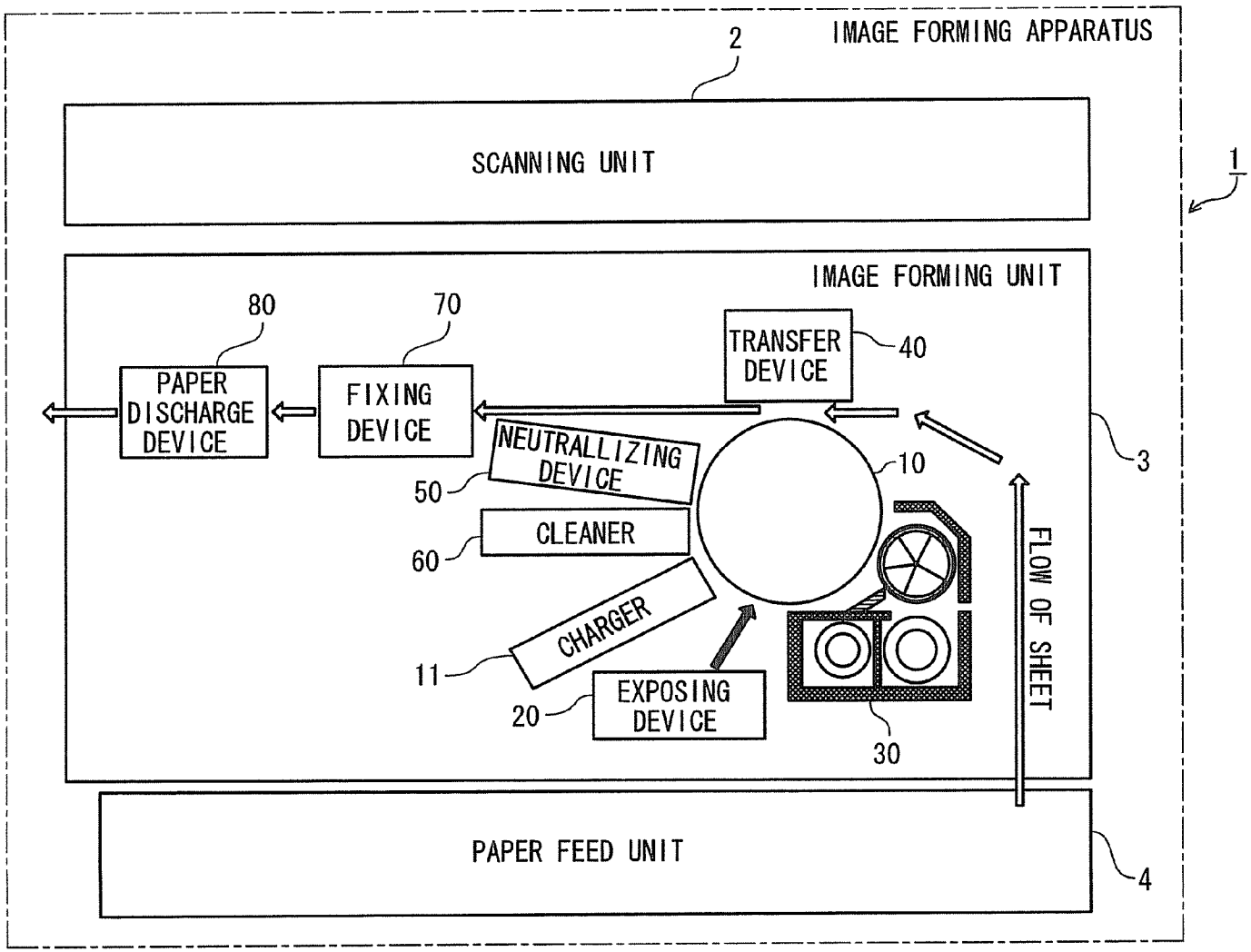
FIG. 2 is a sectional view showing an exemplary configuration of an image forming apparatus according to an embodiment of the invention.

FIG. 2 is a schematic sectional view showing an exemplary internal configuration of the image forming unit 3.

The image forming unit 3 has, in the vicinity of its center, a photoconductive drum 10 that rotates in the direction of the arrow shown in FIG. 2. Around the photoconductive drum 10, a charger 11, an exposing device 20, a developing apparatus 30, a transfer device 40, a neutralizing device 50, and a cleaner 60 are arranged sequentially from upstream to downstream of the rotation.

The charger 11 uniformly charges the surface of the photoconductive drum 10 to a predetermined potential. The exposing device 20 casts a laser beam modulated in accordance with the intensity of image data, to the surface of the photoconductive drum 10. When the laser beam is cast, the potential of that part is lowered and an electrostatic latent image is thus formed on the surface of the photoconductive drum 10.

The developing apparatus 30 causes a developer to adhere to the surface of the photoconductive drum 10 and develops the electrostatic latent image. In this embodiment, a two-component developer containing toner and magnetic particles is used as the developer. The electrostatic latent image is developed with the toner contained in the developer. A toner image is thus formed on the surface of the photoconductive drum 10.

Meanwhile, a sheet is carried from the paper feed unit 4 toward a transfer position (a position where the photoconductive drum 10 and the transfer device 40 face each other). The toner image on the photoconductive drum 10 is transferred onto the sheet by the transfer device 40.

The sheet to which the toner image has been transferred is carried to a fixing device 70 provided downstream of the transfer device 40. The fixing device 70 fixes the toner image to the sheet by heating and pressurizing it. The sheet on which fixing has been finished is discharged outside by a paper discharge device 80.

The photoconductive drum 10, on which the transfer to the sheet has been finished, has its surface charges removed by the neutralizing device 50. Also, the cleaner 60 removes the remaining toner from the surface.

As the above processing is repeated, continuous printing can be carried out.

(2) Developing Apparatus

Figure 3:
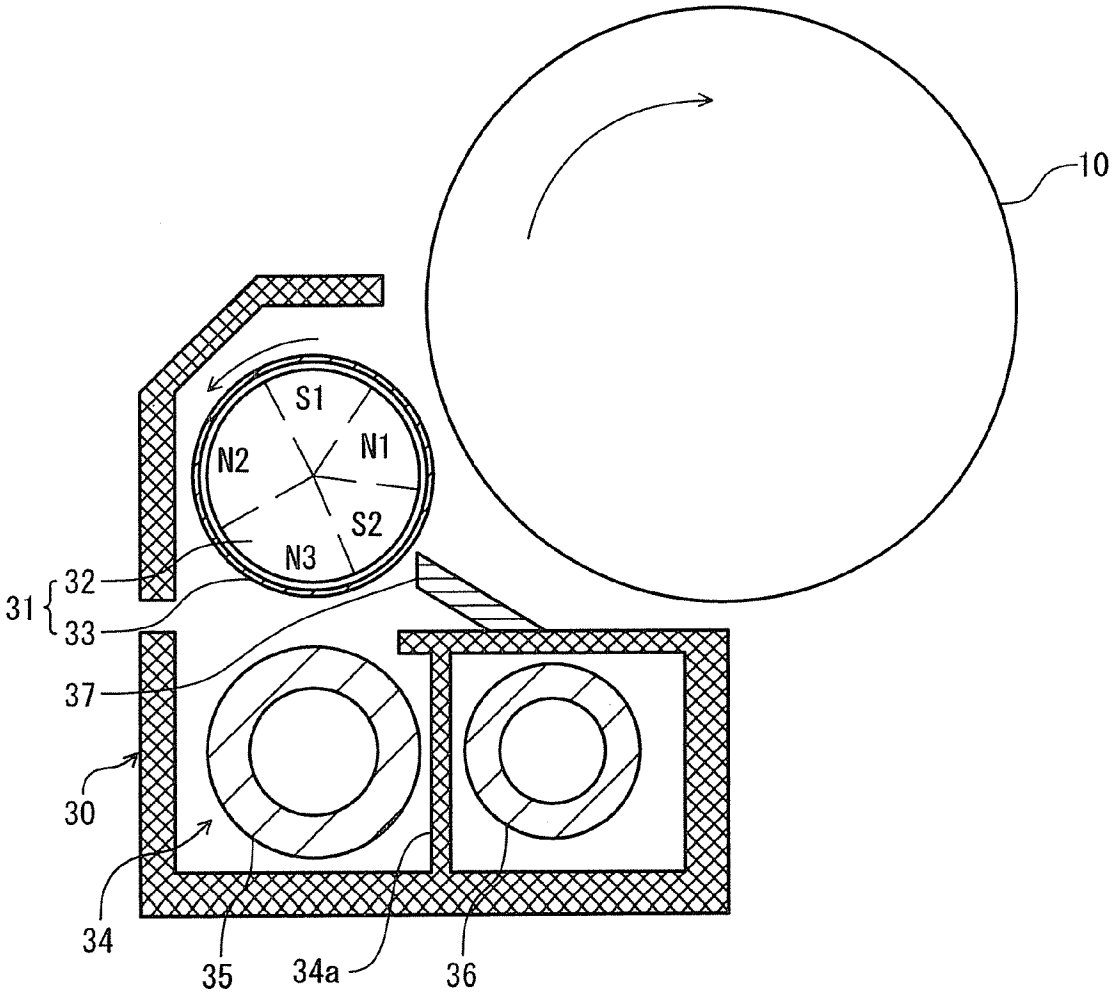
FIG. 3 is a sectional view showing an exemplary configuration of a developing apparatus according to an embodiment of the invention.

FIG. 3 is a schematic sectional view showing an exemplary configuration of the details of the developing apparatus 30. FIG. 3 also shows the photoconductive drum 10 facing the developing apparatus 30.

The developing apparatus 30 has a developing roller 31, a stirring unit 34 and a doctor blade 37 as its principal components.

The developing roller 31 has a columnar magnet roller 32 and a cylindrical sleeve 33 that houses this magnet roller 32.

The magnet roller 32 includes a five-pole magnet extending in the axial direction. The poles of the magnet are called a grip pole N3 (N-pole), a blade regulating pole S2 (S-pole), a developing pole N1 (N-pole), a carrying pole S1 (S-pole), and a stripping pole N2 (N-pole). The magnet roller 32 is fixed and does not rotate.

Meanwhile, the sleeve 33 is rotated in the direction of the arrow shown in FIG. 3 by a driving mechanism (not shown) provided at an end in the axial direction. The sleeve 33 is made of, for example, an aluminum tube and has multiple micro recesses formed on its circumferential surface in a pattern that will be described later.

The stirring unit 34 has two augers 35 and 36. A partition 34*a* is provided between the auger 35 and the auger 36. The space around the augers 35 and 36 is filled with the developer carried by a carrying mechanism, not shown.

As the partition 34*a* is opened at both ends in the axial direction, the developer around the augers 35 and 36 circulates in the axial direction while being stirred by the rotations of the augers 35 and 36.

As described above, the developer according to this embodiment is a two-component developer containing toner and carrier (magnetic particles). The toner and carrier are electrostatically coupled by static electricity generated by friction at the time of stirring.

The stirred developer flows roughly in the following manner.

The developer (electrostatically coupled toner and carrier) is caused to adhere to the sleeve 33 in the vicinity of the grip pole N3 by a magnetic force acting between the grip pole N3 and the carrier.

The developing adhering to the sleeve 33 is carried to the position of the blade regulating pole S2 that is next to the grip pole N3, by the rotation of the sleeve 33. The doctor blade 37 is provided at the position facing the blade regulating pole S2. As the developer passes through the gap between the doctor blade 37 and the sleeve 33, the thickness of the developer is regulated. On the surface of the sleeve 33 that has passed over the doctor blade 37, a layer of the developer with a desired uniform thickness is formed. In this layer of the developer, a developer brush is formed in which the carrier is tied in a row.

The developer formed in the layer shape is further carried from the blade regulating pole S2 to the position of the developing pole N1 by the rotation of the sleeve 33, and then reaches the developing area (the area where the sleeve 33 and the photoconductive drum 10 face each other).

A predetermined potential is applied to the sleeve 33 by application means, not shown. In the developing area, an electric field is generated by the difference between the potential of the sleeve 33 and the potential on the electrostatic latent image on the photoconductive drum 10. Since the toner is charged, an electric force by this electric field acts on the toner. By this electric force, the toner is attracted onto the electrostatic latent image on the photoconductive drum 10 and develops the electrostatic latent image.

The toner and carrier remaining on the sleeve 33 are carried from the position of the developing pole N1 to the position of the carrying pole S1 by further rotation of the sleeve 33, and then carried up to the position of the stripping pole N2. Since the stripping pole N2 and the grip pole N3 have the same N-pole, a force to strip the carrier from the surface of the sleeve 33 acts. By this force, the carrier and the remaining toner that is electrostatically coupled with the carrier are stripped off the surface of the sleeve 33 and returned to the stirring unit 34.

(3) Developing Roller (First Embodiment)

As described above, the developer at the position of the grip pole N3 is attracted to the sleeve 33, and then is carried from the position of the grip pole N3 to the position of the blade regulating pole S2 and further to the position of the developing pole N1 (developing area) while adhering to the surface of the sleeve 33.

At this time, if the surface of the sleeve 33 is perfectly smooth, the developer is separated from the surface of the sleeve 33 and a stable quantity of the developer cannot be carried to the developing position.

Thus, conventionally, surface treatment is performed on the surface of the sleeve in order to generate proper friction resistance.

Sandblasting and knurling are conventionally known techniques of surface treatment for the sleeve.

Figure 4A:
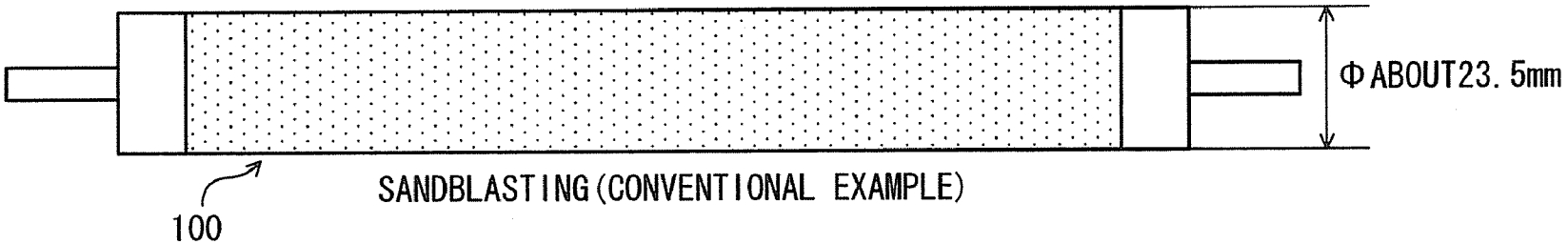
FIG. 4A and FIG. 4B are views showing exemplary appearances of a developing roller according to conventional examples.

FIG. 4A is a view showing an exemplary appearance of a conventional developing roller 100 having a sleeve on which surface treatment is done by sandblasting.

As described above, the surface processed by sandblasting is a granulated rough surface and has high friction resistance. However, as the developing roller is used for a long period, the surface is ground by the developer and the surface roughness is gradually lowered. Consequently, friction resistance is lowered and the developer cannot be carried in a stable adhering state.

Figure 4B:
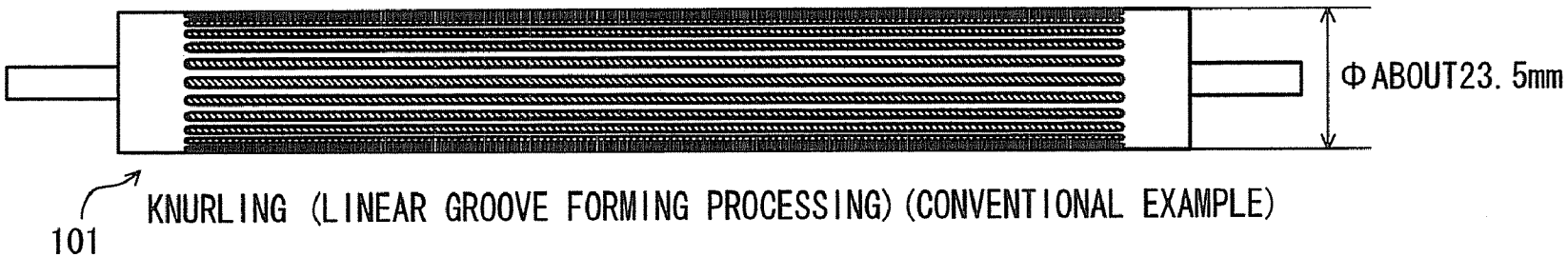

On the other hand, FIG. 4B is a view showing an exemplary appearance of a conventional developing roller 101 having a sleeve that is processed by knurling (processing to form multiple grooves parallel to the axis of the developing roller, on the surface of the sleeve). Each groove has a length that is approximately the same as the length of the developing roller in the axial direction, as shown in FIG. 4B.

Processing methods by knurling include, for example, a method of pressing a metal mold to an aluminum tube and forming grooves thereon, a method of forming grooves by etching, and so on.

The multiple grooves formed on the surface generate high friction resistance to the developer. Moreover, since protrusions that would be generated by sandblasting are not generated in this case and deeper recesses can be formed than in sandblasting, friction resistance is not significantly lowered even if the developing roller is used for a long period.

However, when development is carried out with the developing roller processed by knurling, there is a problem that an unwanted stripe pattern corresponding to the grooves is generated on the developed toner image. This unwanted strip pattern is particularly conspicuous in a broad, solid area such as a blue sky background.

Generally, human eyes can recognize a continuous straight line more easily than discrete dots. Even when the density of a straight line is very low, if the straight line is continuous in a certain range, the presence of the straight line can be identified by naked eyes relatively easily. In the case where straight lines are cyclically arrayed at equal intervals, the presence of the line can be identified more easily.

Thus, in this embodiment, a pattern is formed which maintains the ability to carry the developer and from which continuity and cyclicity are eliminated as much as possible, in order to make the pattern less identifiable to human eyes.

Figure 5A:
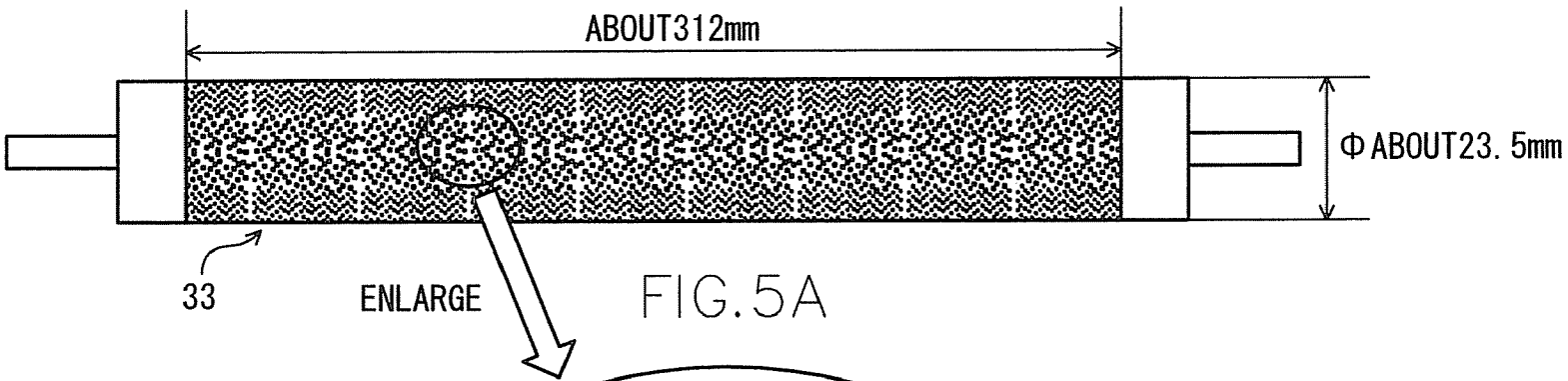
FIG. 5A and FIG. 5B are views showing an exemplary appearance of a developing roller according to the first embodiment of the invention.
Figure 5B:
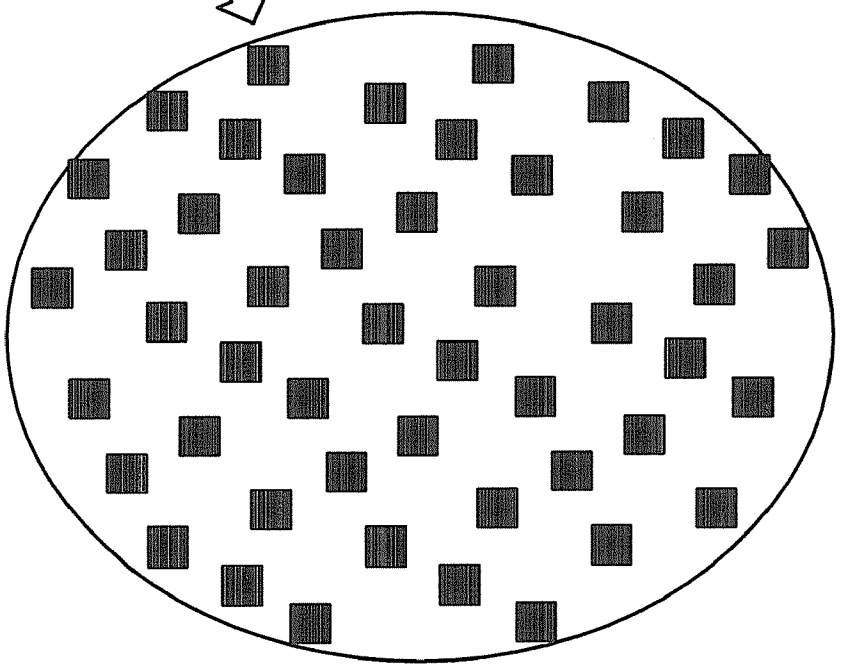

FIG. 5A is a view showing an exemplary appearance of the developing roller 31 according to this embodiment. FIG. 5B is an enlarged view of a pattern formed on the surface of the sleeve 33. In this embodiment, the outer diameter of the sleeve 33 is about 23.5 mm and its length in the axial direction is about 312 mm.

Figures 6A, 6B:
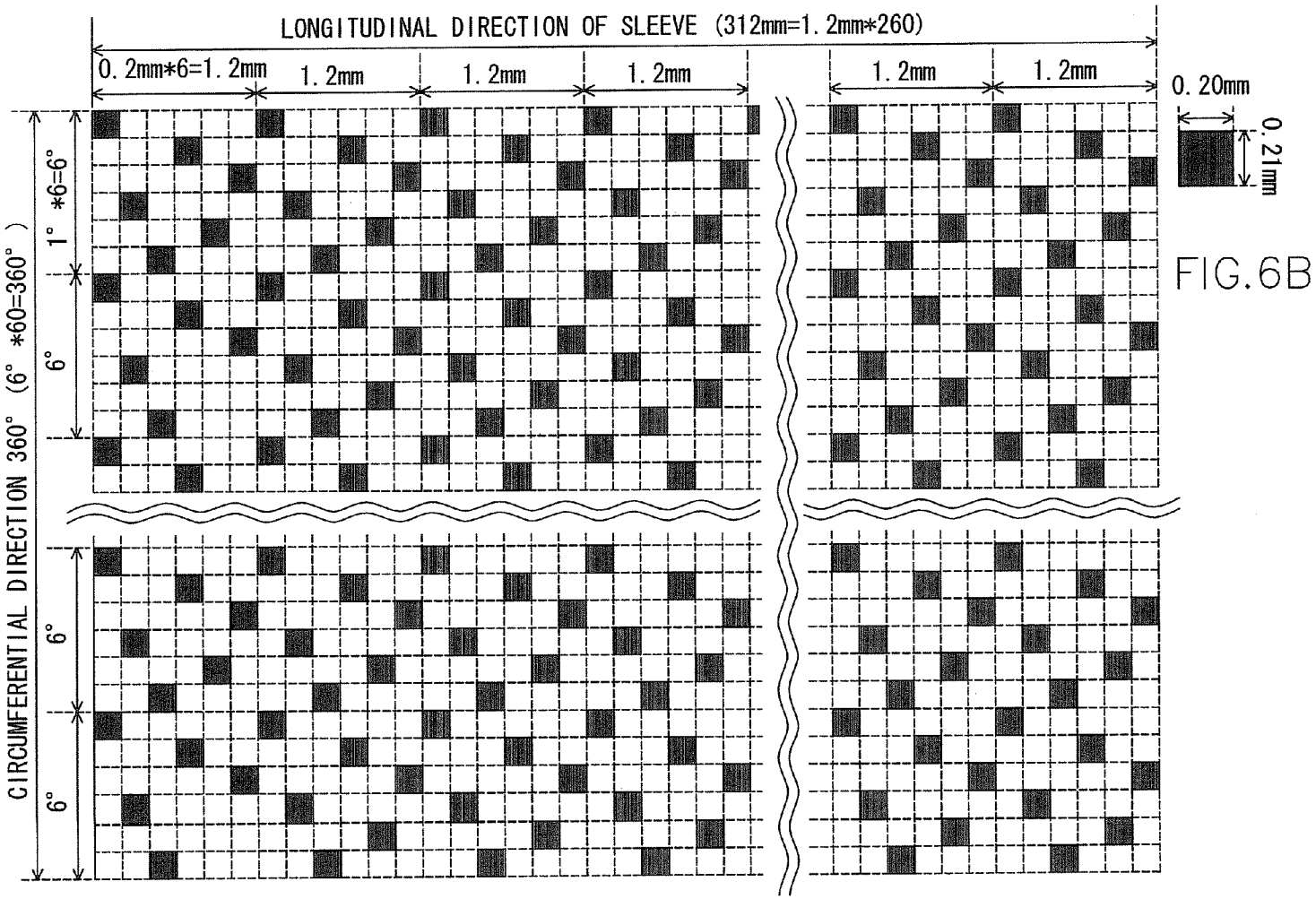
FIG. 6A and FIG. 6B are views showing an exemplary pattern on a sleeve of the developing roller according to the first embodiment.

FIG. 6A is a view showing the pattern of FIG. 5B further in detail. The horizontal direction in FIG. 6A corresponds to the longitudinal direction (axial direction) of the sleeve 33. The vertical direction corresponds to the range from 0 to 360 degrees of the circumference of the sleeve 33 as it is spread.

As shown in FIG. 6A, multiple fragmented micro recesses are formed on the sleeve 33 according to this embodiment. The micro recesses are arrayed dispersively both in the axial direction and in the circumferential direction of the sleeve.

More specifically, the entire surface of the sleeve 33 is virtually divided into cells, each being about 0.20 mm in the axial direction and about 0.21 mm (an angle of 1° in the circumferential direction corresponds to about 0.21 mm) in the circumferential direction (see FIG. 6B). Micro recesses are formed at the positions of cells isolated from each other. Between a micro recess and micro recesses next to it in the axial direction and the circumferential direction, a flat area including one or more cells is provided. In the example of FIG. 6A, each flat area includes five cells.

In a section consisting of 36 cells (six in the axial direction and six in the circumferential direction), the arrangement of the micro recesses is two-dimensionally random. Therefore, as can be seen from FIG. 6A, when the entire sleeve 33 is looked at, no continuity or cyclicity can be perceived in the axial direction or in the circumferential direction and it gives an impression that the micro recesses are randomly arranged on the entire sleeve 33.

Therefore, even if the pattern of FIG. 6A is transferred as an unwanted pattern to the surface of the photoconductive drum 10, it is very difficult to visually recognize the unwanted pattern with naked eyes because the pattern has no continuity or cyclicity.

In this embodiment, the opening of each micro recess has almost the same shape (rectangular) and almost the same size as one cell. However, the opening of the micro recesses is not limited to this shape and size. For example, micro recesses may have a circular opening shape.

The micro recesses can be formed, for example, by etching. Masking ink is printed and solidified on an aluminum tube by an inkjet device or the like. After that, the aluminum tube is immersed in an etching solution. Alternatively, an etching solution is applied to the aluminum tube. By these processes, non-masked areas are dissolved and form micro recesses. After that, as removal of the masking ink is carried out, the sleeve 33 having the pattern shown in FIG. 6A and so on is produced.

Figure 7:
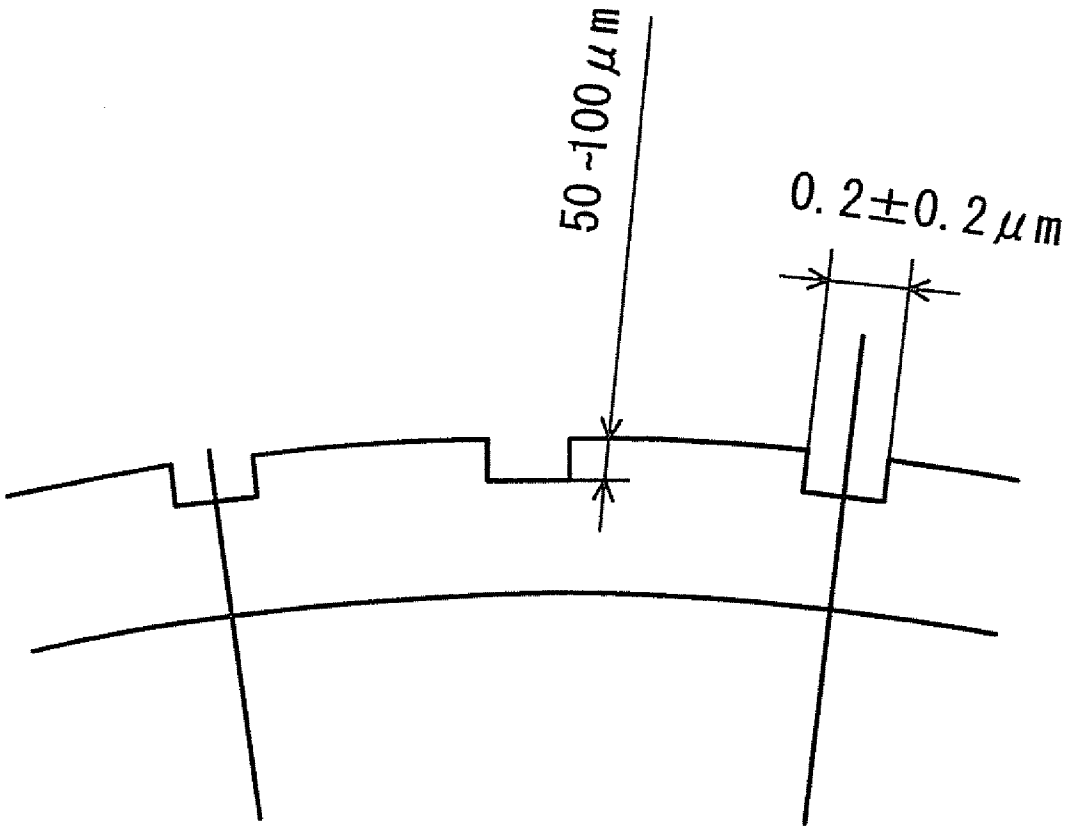
FIG. 7 is a lateral sectional view of the sleeve of the developing roller according to the first embodiment.

FIG. 7 is a lateral sectional view of the sleeve 33. It is preferable that the depth of micro recesses is within the range of 50 to 100 μm in view of the ability to carry the developer and the processibility of the micro recesses.

(4) Effect Check Testing

To check the effect of the developing roller 31 according to this embodiment, effect check testing was carried out by comparing this embodiment with a developing roller having a sleeve shape according to a conventional example.

FIG. 8, FIG. 9A, FIG. 9B, FIG. 10A and FIG. 10B show the results of the testing.

FIG. 8 is a table showing the result of visual recognition and determination of the condition of an image printed by using the developing roller processed by knurling according to the conventional example, and the condition of an image printed by using the developing roller according to this embodiment.

For the developing roller according to the conventional example, a sleeve was produced which has plural grooves provided thereon parallel to the axial direction as shown in FIG. 4B. The number of the grooves was 60. The width of each groove was about 0.2 mm.

As for the depth of the groove, three types of grooves having depths of 30 μm, 50 μm and 70 μm were produced and the testing was carried out with these grooves. The grooves were formed by etching.

As a result of the testing, with the developing roller according to the conventional example having any of the depths of 30 μm, 50 μm and 70 μm, the traces of the grooves appear on the image and it was determined that the condition of the image was defective.

On the other hand, in the developing roller 31 according to this embodiment, the pattern shown in FIG. 6A and FIG. 6B was used as the pattern on the sleeve 33. As for the size of each cell (in this case, corresponding to the size of a micro recess), four types of sleeves 33 having the cell sizes of 0.2×0.2 mm, 0.3×0.3 mm, 0.4×0.4 mm and 0.5×0.5 mm were produced and used for the testing.

The micro recesses were formed by etching as in the conventional example. The depth of the micro recesses was within the range of 50 to 90 μm in each case.

As a result of the testing, with all the four types of sleeves 33, unwanted traces corresponding to the pattern on the sleeve 33 did not appear and images in good conditions were acquired.

FIG. 9A, FIG. 9B, FIG. 10A and FIG. 10B are views showing the result of comparative testing between a sandblasted developing roller according to a conventional example and the developing roller 31 according to this embodiment.

Figure 9A:
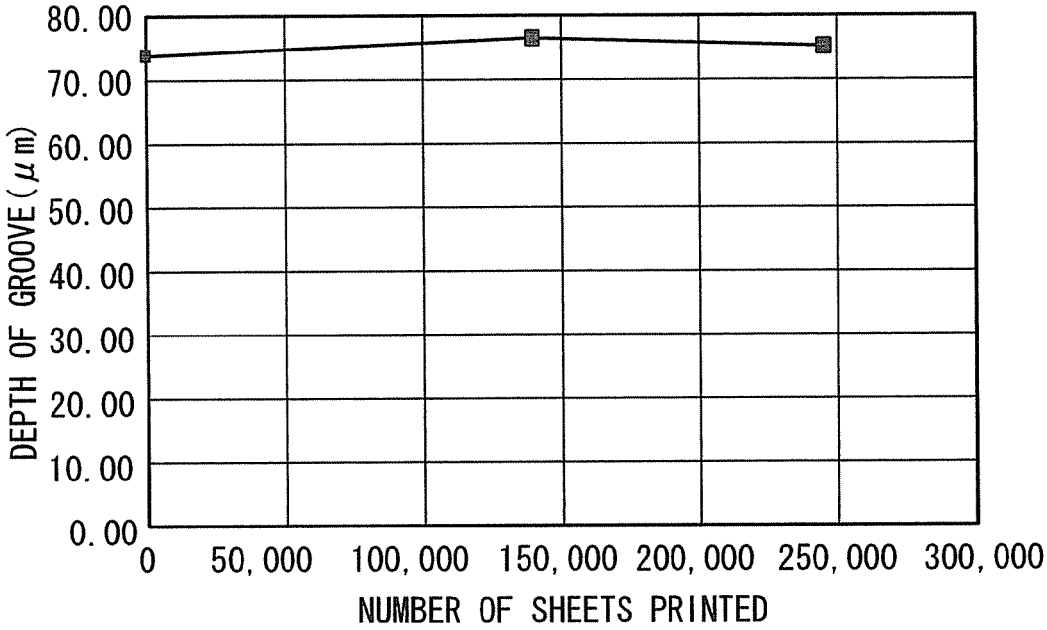
FIG. 9A and FIG. 9B are graphs showing the result of testing of change with time in the depth of micro recesses on the developing roller according to the first embodiment, and change with time in the quantity of the developer carried.

FIG. 9A is a graph showing the result of checking change in depth of the micro recesses with respect to the number of sheets printed, with the developing roller 31 according to this embodiment. Even when the number of sheets printed increased (the time of use became longer), the depth of the micro recesses hardly changed from the initial state. The graph shows the result of up to 250,000 sheets. However, even after printing was continued on up to 500,000 sheets, change in the depth of the micro recesses was hardly observed.

Figure 9B:
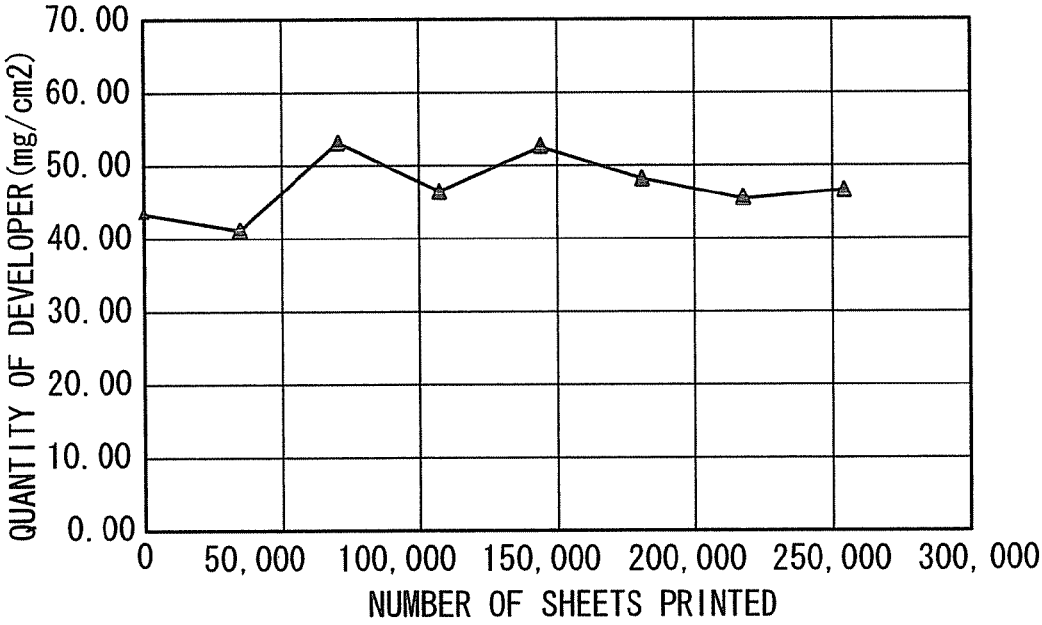

FIG. 9B is a graph showing the result of checking change in the quantity of developer carried with respect to the number of sheets printed, with the developing roller 31 according to this embodiment, as in FIG. 9A. Even when the number of sheets printed increased (the time of use became longer), the quantity of developer carried hardly changed from the initial state. Even after printing was continued on up to 500,000 sheets, change in the quantity of developer carried was hardly observed.

Figure 10A:
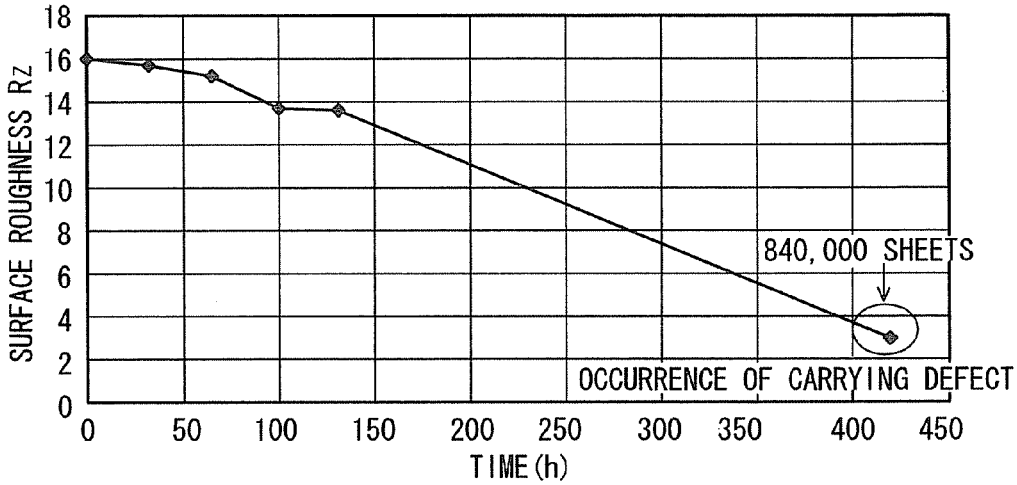
FIG. 10A and FIG. 10B are graphs showing the result of testing of change with time in the depth of micro recesses on the sandblasted developing roller according to the conventional example, and change with time in the quantity of the developer carried.

On the other hand, with the sandblasted developing roller according to the conventional example, when the time of use exceeded 400 hours (corresponding to the number of sheets printed, 840,000), a developer carrying defect occurred, as shown in FIG. 10A. At that time, the surface roughness Rz had been lowered to ¼ or less from the initial state.

Figure 10B:
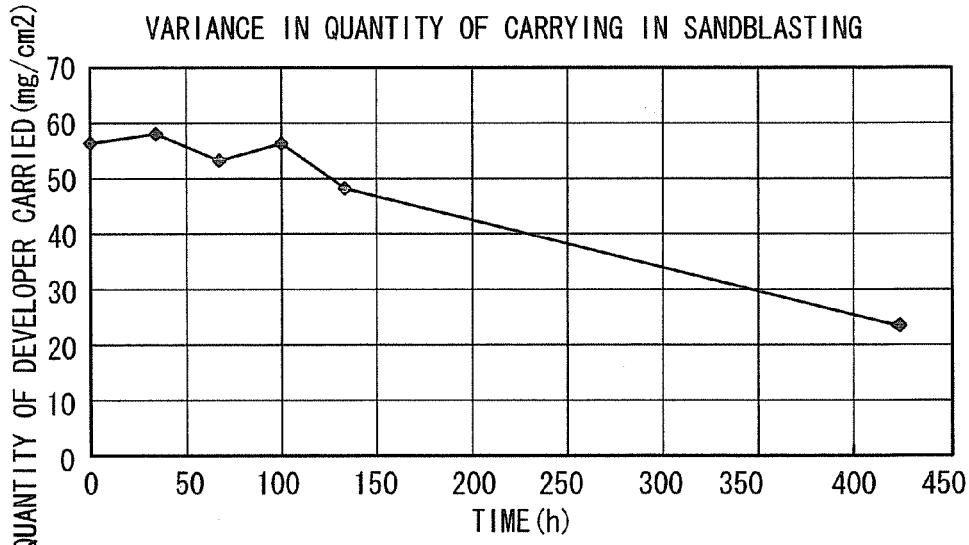

Moreover, when the time of use exceeded 400 hours, the quantity of developer carried was lowered ½ or less (about 20 $mg/cm^2$) from the initial state (about 55 $mg/cm^2$), as shown in FIG. 10B.

By the above testing, it has been confirmed that the developing roller 31 according to this embodiment is superior in terms of image quality to the conventional developing roller processed by knurling, and is superior in terminal of life to the conventional sandblasted developing roller.

(5) Other Embodiments

Figures 11A, 11B:
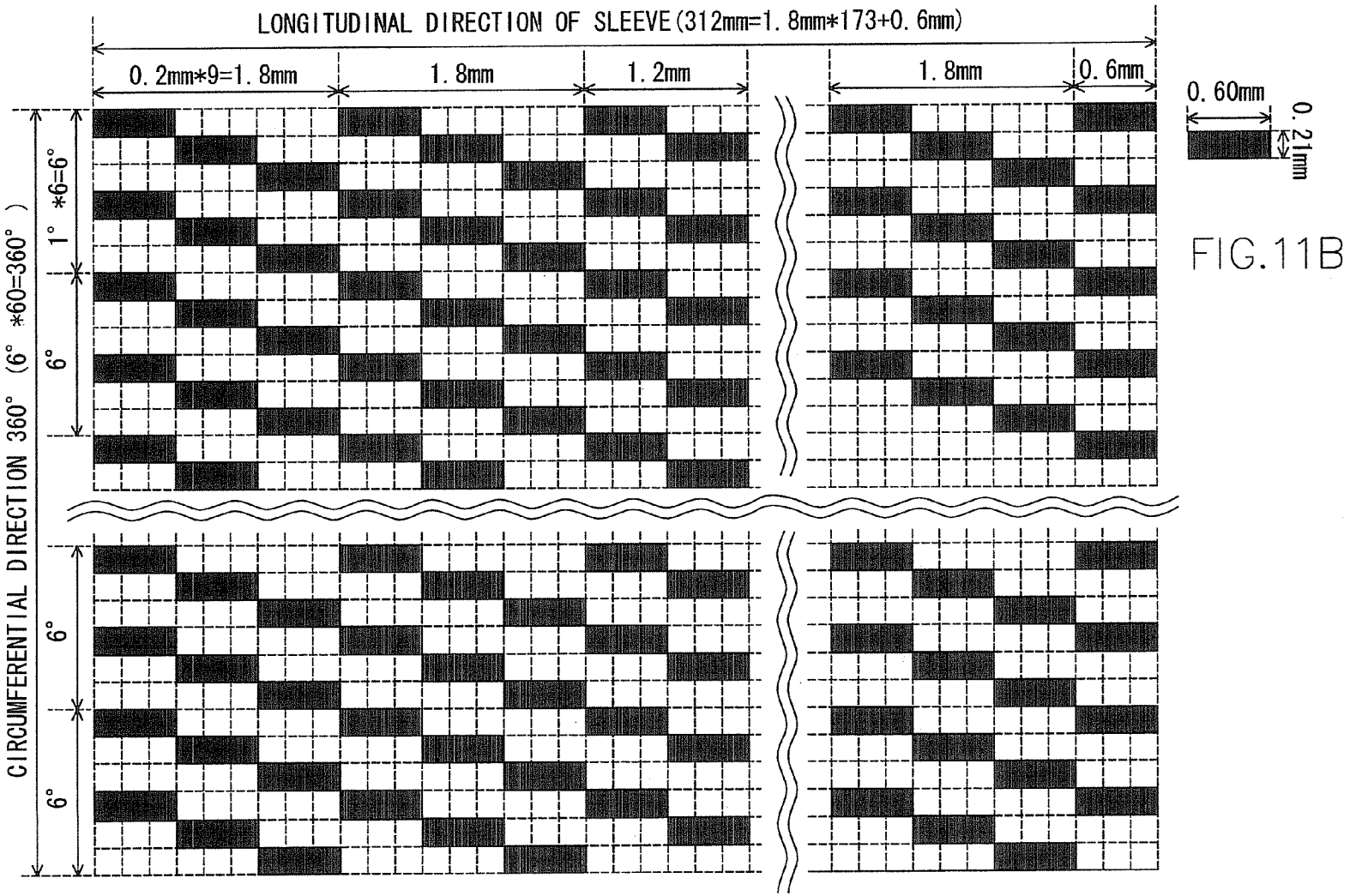
FIG. 11A and FIG. 11B are views showing an exemplary pattern on a sleeve of a developing roller according to the second embodiment.

FIG. 11A and FIG. 11B are views showing an exemplary pattern on a sleeve 33*a* of a developing roller 31*a* according to the second embodiment. On the sleeve 33 according to the first embodiment, the size and shape of a micro recess are approximately the same as the size and shape of a cell. On the other hand, on the sleeve 33*a* according to the second embodiment, the shape of a micro recess is a rectangle that is long in the axial direction. In the specific example shown in FIG. 11A and FIG. 11B, three cells that are consecutive in the axial direction form one micro recess.

Also on the sleeve 33*a* according to the second embodiment, a flat area consisting of one or more cells is provided between a micro recess and micro recesses that are next to it in the axial direction and in the circumferential direction. In the specific example shown in FIG. 11A, a flat area consisting of six cells is provided in the axial direction and a flat area consisting of two cells is provided in the circumferential direction.

In this way, also in the second embodiment, the micro recesses are fragmented in the axial direction and in the circumferential direction, showing a discontinuous shape. Therefore, even if the pattern of FIG. 11A is transferred on to the surface of the photoconductive drum 10 as an unwanted pattern, it is very difficult to visually recognize the pattern with naked eyes because the pattern has no continuity, as in the first embodiment.

Figure 12A:
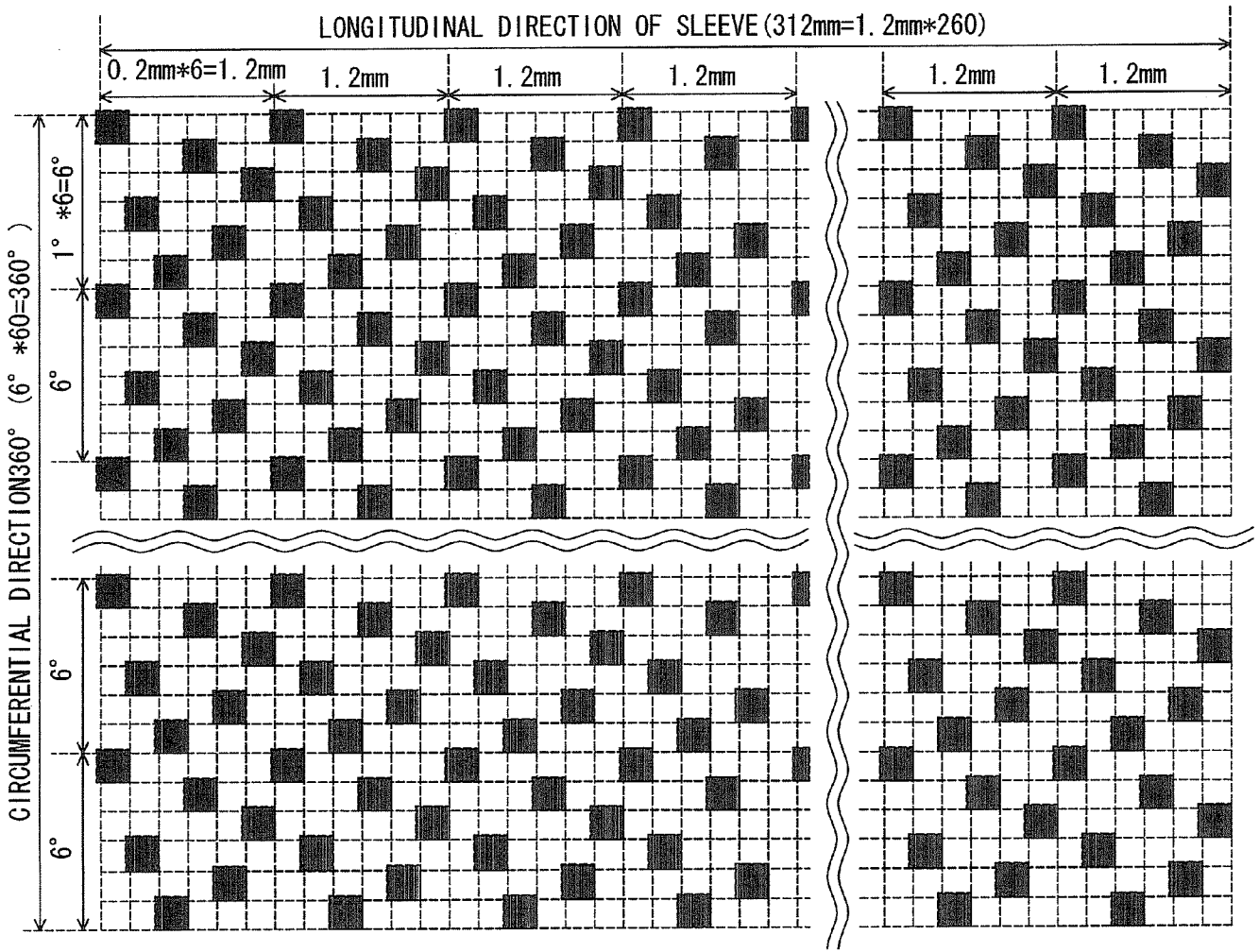
FIG. 12A and FIG. 12B are views showing an exemplary pattern on a sleeve of a developing roller according to the third embodiment.
Figure 12B:
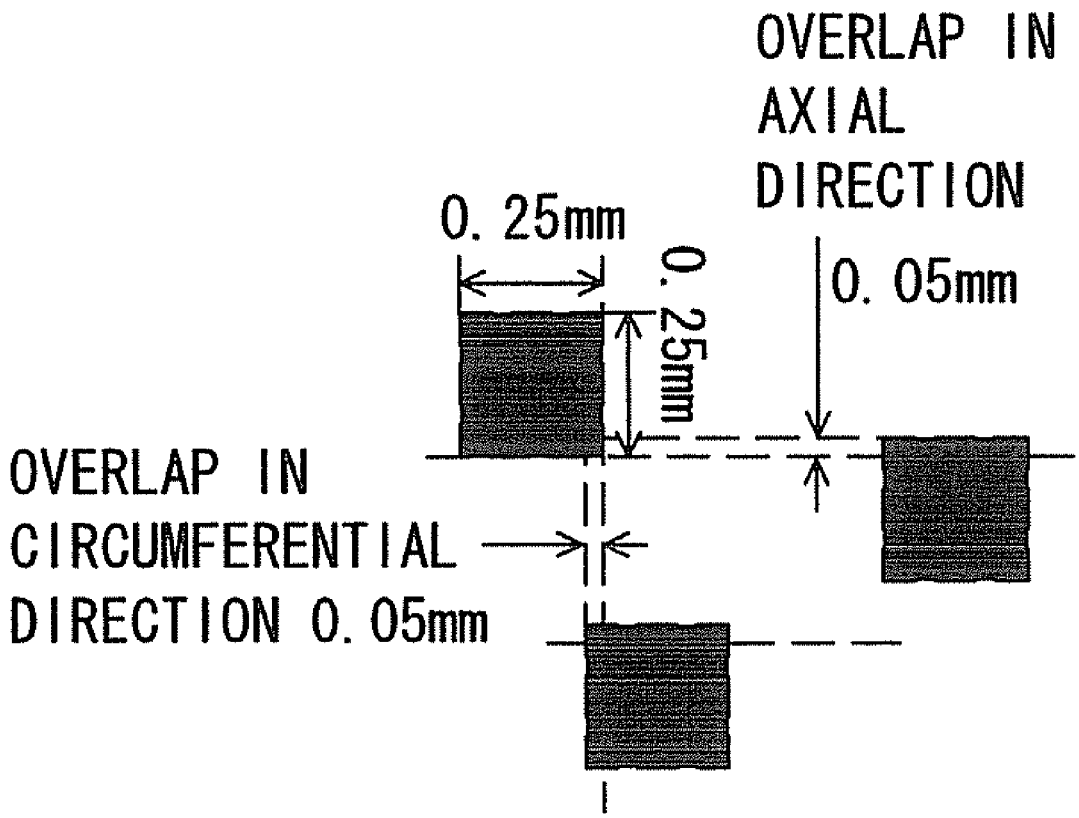

FIG. 12A and FIG. 12B are views showing an exemplary pattern on a sleeve 33*b* of a developing roller 31*b* according to the third embodiment. On the sleeve 33 according to the first embodiment, the size and shape of a micro recess are approximately the same as the size and shape of a cell. On the other hand, on the sleeve 33*b* according to the third embodiment, the size of each micro recess is larger than in the first embodiment while the shape and layout of micro recesses are the same as in the first embodiment. In the specific example shown in FIG. 12A and FIG. 12B, each micro recess has a size of about 0.25×about 0.25 mm, which is 0.05 mm larger than the size of a cell (about 0.2×about 0.2 mm) vertically and horizontally.

Consequently, as shown in FIG. 12B, the vertical and horizontal edges of the micro recess is displaced by 0.05 mm from the lines of the cell matrix extending in the axial direction and in the circumferential direction. In other words, the micro recesses are arrayed in such a manner that micro recesses arrayed in a row in the axial direction overlap micro recesses in the next row by 0.05 mm. Similarly, the micro recesses are arrayed in such a manner that micro recesses arrayed in a column in the circumferential direction overlap micro recesses in the next column by 0.05 mm.

With such layout, the edges of the micro recesses arranged in the rows or columns next to each other are alternately displaced from the lines of the cell matrix. Thus, continuity and cyclicity of the pattern is further reduced when the entire pattern is viewed. Consequently, even if the pattern of FIG. 12A is transferred onto the surface of the photoconductive drum 10 as an unwanted pattern, it is very difficult as in the first embodiment, or even more difficult than in the first embodiment, to visually recognize the pattern with naked eyes.

As is described above, with the developing rollers 31, 31*a* and 31*b*, the developing apparatus 30 and the image forming apparatus 1 according to the embodiments, no unwanted stripe pattern is generated, which could be generated by the conventional sleeve processed by knurling, and there is no deterioration in performance due to change with time that could occur in the sandblasted sleeve.

The invention is not limited to the above embodiments themselves. Practically, components of the embodiments can be modified without departing from the scope of the invention. Also, an invention having various embodiments can be formed by proper combinations of plural components disclosed in the above embodiments. For example, of all the components disclosed in the embodiments, some components may be deleted. Moreover, components from different embodiments can be properly combined.

What is claimed is:

1. A developing roller comprising:

a columnar magnet roller; and a cylindrical sleeve that houses the magnet roller, the surface of the sleeve comprising a plurality of fragmented recesses formed thereon, the recesses being arranged separately and dispersively both in an axial direction and in a circumferential direction of the sleeve, wherein a recess is enclosed by an axial flat area and a circumferential flat area and the axial flat area enclosing the recess in the axial direction has a larger area than the recess, and the circumferential flat area enclosing the recess in the circumferential direction has a larger area than the recess.

2. The developing roller according to claim 1, wherein the recesses have a substantially rectangular opening shape.

3. The developing roller according to claim 1, wherein the recesses have a substantially circular opening shape.

4. The developing roller according to claim 1, wherein the recesses are formed and arranged in such a manner that in order to prevent an edge in the axial direction of all the recesses arrayed in the axial direction from being placed on one straight line, the edge in the axial direction of a part of the recesses is displaced from the straight line, and in order to prevent an edge in the circumferential direction of all the recesses arrayed in the circumferential direction from being placed on one circumferential line, the edge in the circumferential direction of a part of the recesses is displaced from the circumferential line.

5. The developing roller according to claim 1, wherein the recesses are formed by etching.

6. A developing apparatus comprising:

a stirring unit configured to stir a developer;

a developing roller that has the stirred developer adhering to its surface and carries the developer to a position facing a photoconductor, the developing roller comprising a columnar magnet roller and a cylindrical sleeve that houses the magnet roller, the surface of the sleeve comprising a plurality of fragmented recesses formed thereon, the recesses being arranged separately and dispersively both in an axial direction and in a circumferential direction of the sleeve, wherein a recess is enclosed by an axial flat area and a circumferential flat area and the axial flat area enclosing the recess in the axial direction has a larger area than the recess, and the circumferential flat area enclosing the recess in the circumferential direction has a larger area than the recess; and a doctor blade that regulates the thickness of the developer adhering to the developing roller.

7. The developing apparatus according to claim 6, wherein the recesses have a substantially rectangular opening shape.

8. The developing apparatus according to claim 6, wherein the recesses have a substantially circular opening shape.

9. The developing apparatus according to claim 6, wherein the recesses are formed and arranged in such a manner that in order to prevent an edge in the axial direction of all the recesses arrayed in the axial direction from being placed on one straight line, the edge in the axial direction of a part of the recesses is displaced from the straight line, and in order to prevent an edge in the circumferential direction of all the recesses arrayed in the circumferential direction from being placed on one circumferential line, the edge in the circumferential direction of a part of the recesses is displaced from the circumferential line.

10. The developing apparatus according to claim 6, wherein the recesses are formed by etching.

11. An image forming apparatus comprising:

a photoconductive drum;

an exposing device that casts light to the photoconductive drum and forms an electrostatic latent image on the surface of the photoconductive drum;

a developing apparatus that causes toner to adhere to the electrostatic latent image and develops a toner image;

a transfer device that transfers the developed toner image onto a sheet; and a fixing device that fixes the toner image transferred onto the sheet, the developing apparatus comprising:

a stirring unit configured to stir a developer;

a developing roller that has the stirred developer adhering to its surface and carries the developer to a position facing a photoconductor, the developing roller comprising a columnar magnet roller and a cylindrical sleeve that houses the magnet roller, the surface of the sleeve comprising a plurality of fragmented recesses formed thereon, the recesses being arranged separately and dispersively both in an axial direction and in a circumferential direction of the sleeve, wherein a recess is enclosed by an axial flat area and a circumferential flat area and the axial flat area enclosing the recess in the axial direction has a larger area than the recess, and the circumferential flat area enclosing the recess in the circumferential direction has a larger area than the recess; and a doctor blade that regulates the thickness of the developer adhering to the developing roller.

12. The image forming apparatus according to claim 11, wherein the recesses have a substantially rectangular opening shape.

13. The image forming apparatus according to claim 11, wherein the recesses have a substantially circular opening shape.

14. The image forming apparatus according to claim 11, wherein the recesses are formed and arranged in such a manner that in order to prevent an edge in the axial direction of all the recesses arrayed in the axial direction from being placed on one straight line, the edge in the axial direction of a part of the recesses is displaced from the straight line, and in order to prevent an edge in the circumferential direction of all the recesses arrayed in the circumferential direction from being placed on one circumferential line, the edge in the circumferential direction of a part of the recesses is displaced from the circumferential line.

15. The image forming apparatus according to claim 11, wherein the recesses are formed by etching.

* * * * *